US005438338A

United States Patent [19]

Thill

[11] Patent Number: 5,438,338

[45] Date of Patent: Aug. 1, 1995

[54] GLASS MOUNTED ANTENNA

[76] Inventor: Kevin Thill, 7403 Fifth Ave., Kenosha, Wis. 53143

[21] Appl. No.: 283,086

[22] Filed: Jul. 29, 1994

[51] Int. Cl.[6] ..... H01Q 1/38; H01Q 1/32

[52] U.S. Cl. ..... 343/700 MS; 343/713; 343/860

[58] Field of Search ..... 343/700 MS, 713, 749, 343/850, 860, 861; H01Q 1/32, 1/50, 1/38

[56] References Cited

U.S. PATENT DOCUMENTS

| | | | |
|---|---|---|---|
| Re. 33,743 | 11/1991 | Blaese | 343/715 |
| 4,623,893 | 11/1986 | Sabban | 343/700 MS |
| 4,821,040 | 4/1989 | Johnson et al. | 343/700 MS |
| 4,847,625 | 6/1989 | Dietrich et al. | 343/700 MS |
| 4,987,421 | 1/1991 | Sunahara et al. | 343/700 MS |
| 5,010,349 | 4/1991 | Mizuno et al. | 343/700 MS |
| 5,041,838 | 8/1991 | Liimatainen et al. | 343/700 MS |
| 5,105,201 | 4/1992 | Nakase et al. | 343/715 |
| 5,120,541 | 5/1993 | Pett et al. | 343/700 MS |

*Primary Examiner*—Michael C. Wimer

[57] ABSTRACT

An antenna includes a first element that attaches to the outside surface of a window and includes a disk-shaped first dielectric substrate with a pair of major surfaces covered by an electrically conductive layer. The electrically conductive layers are connected by a plurality of tuning posts extending through the first substrate. A second element is attached to the inside surface of the window adjacent to the first element. The second element includes a disk-shaped second dielectric substrate having first and second major surfaces with an edge therebetween. A circular first electrode is centrally located on the first major surface facing the first element and an annular second electrode extends around the first electrode on the first major surface. A third electrode covers the second major surface of the second substrate and a shunt connects the second and third electrodes at the substrate edge. A transceiver connector is located on the edge of the second substrate opposite the shunt for applying an excitation signal between the first and third electrodes.

10 Claims, 1 Drawing Sheet

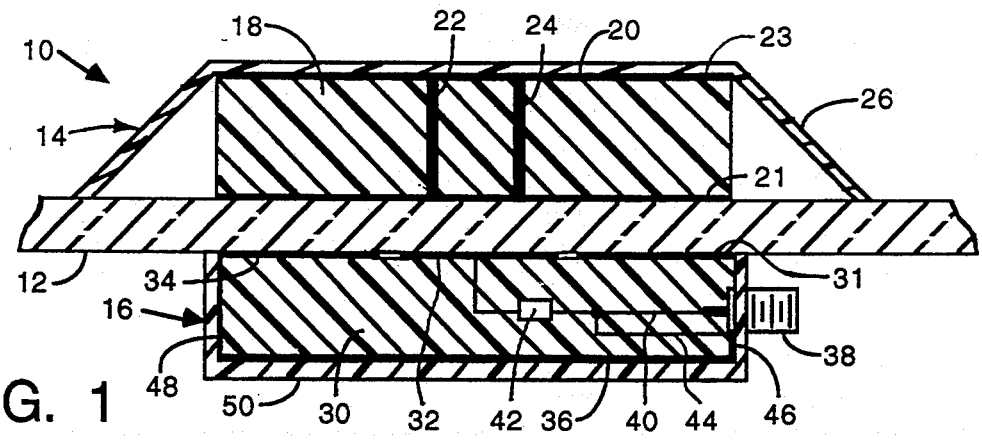
FIG. 1
FIG. 2
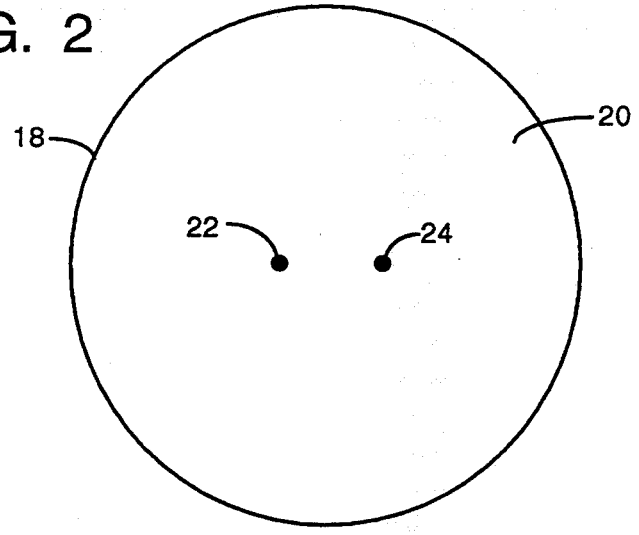
FIG. 3
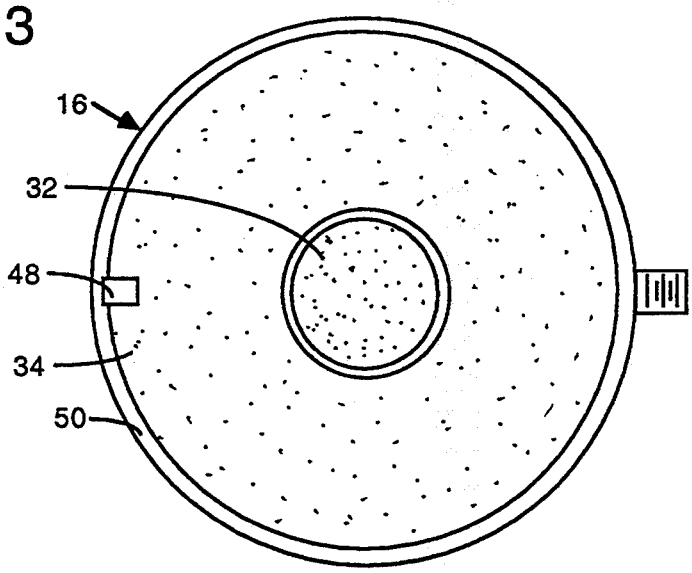

GLASS MOUNTED ANTENNA

BACKGROUND OF THE INVENTION

The present invention relates to through-glass type antennas, and more particularly to such antennas which mount on a window of a vehicle for two-way radio or cellular telephone communication.

Cellular telephones commonly are used for mobile communication with passengers in vehicles. Such telephones usually have a hand-held unit which includes a microphone, a small speaker and a keypad for placing calls and controlling the operation of the telephone. The hand-held unit is coupled by a cable to an electronics module that contains a radio frequency transceiver. The transceiver is coupled to an antenna on the exterior of the vehicle to send and receive the radio frequency signals. Cellular telephones transmit in the 825 to 845 MHz frequency band and receive signals in the 870 to 890 MHz frequency band.

A typical cellular telephone antenna for a motor vehicle is attached to the exterior surface of a window and comprises a short section of rigid wire extending vertically from the vehicle body. A coupling box is mounted on the interior surface of the window opposite to the antenna and is connected by a coaxial cable to the transceiver. The coupling box and the antenna are electrically coupled so that signals from the transmitter section of the transceiver are coupled to the exterior wire from which the signals radiate. The coupling also allows radio frequency signals to be received by the exterior element and applied to the receiver section of the transceiver.

Even though such cellular telephone antennas are relatively short, protruding approximately one foot from the surface of the vehicle, they are subject to accidental breakage and acts of vandalism. Although cellular telephone antennas are considered by some people to be a status symbol, others may consider them to be unsightly and a detraction from the aesthetic appearance of the vehicle.

U.S. Pat. No. 5,041,838 discloses a low profile, flat disk-shaped antenna for cellular telephone usage. This antenna is attached to a horizontal exterior surface of the motor vehicle, such as the roof. A coaxial cable extends through a hole in that surface, connecting the external antenna to the transceiver inside the motor vehicle. Although this antenna was relatively inconspicuous and eliminated some of the aesthetic drawbacks of previous cellular telephone antennas, it required a hole through the body of the motor vehicle for the coaxial cable. Vehicle owners may be hesitant to drill a hole for a cellular telephone as the hole would have to be filled if the cellular telephone was later removed from the vehicle.

It is therefore desirable to create a low-profile antenna which does not require that a hole be drilled through the vehicle body.

SUMMARY OF THE INVENTION

A general object of the present invention is to provide a low-profile antenna having a radiating element mounted on the exterior of a window and electrically coupled, without direct physical connection, to a transceiver located inside the window.

Such an antenna includes a first element that attaches to the exterior of the window, and a second element that attaches to the opposite side of the window facing the first element. The first element has a disk-shaped first substrate of dielectric material with two major surfaces covered with electrically conductive layers. A plurality of conductive tuning posts extend through said first substrate and connect to the electrically conductive layers.

The second element includes a disk-shaped second substrate of dielectric material that has two flat surfaces with an curved edge therebetween. A first electrode is centrally located on one flat surface of said second substrate and a second electrode on the same flat surface extends around said first electrode. A third electrode covers the other flat surface of said second substrate and a shunt is connected between the second and third electrodes. A coupling is provided to connect the second and third electrodes to a radio transceiver. In the preferred embodiment of the antenna, the coupling includes a connector with a first terminal connected to the third electrode and with a second terminal connected by a capacitor to the first electrode. An inductive element is attached between the first and second terminals.

BRIEF DESCRIPTION OF THE DRAWINGS

FIG. 1 is a cross section view of an antenna according to the present invention that is mounted on a window;

FIG. 2 is a plane view of a component of the antenna which mounts on an external surface of the window; and FIG. 3 is a plane view of a component of the antenna which mounts on the interior surface of the window.

DETAILED DESCRIPTION OF THE INVENTION

With reference initially to FIG. 1, an antenna 10 according to the present invention is mounted on a piece of glass 12, such as the window of a motor vehicle. The antenna 10 is formed by an exterior element 14 and an interior element 16 attached to opposite sides of the glass 12 by a suitable adhesive. The antenna 10 will be described in the context of use with a cellular telephone in a motor vehicle. However, an antenna according to the present invention can be tuned for operation at other radio frequencies.

The exterior element 14 includes a disk-shaped substrate 18 of a dielectric material, such as PMI foam. The diameter of the substrate 18 is less than one-half the wavelength of the radio frequencies which the antenna is to transmit and receive. Limiting the diameter in this matter prevents high order modes from being excited. For example, for frequencies commonly used for cellular telephone transmission, the substrate 18 is three inches in diameter and 0.5 inches thick.

The flat major surfaces on opposite sides of the exterior element 14 have brass layers laminated thereon forming first and second conductive layers 20 and 21 which cover the entirety of the respective major surface. A pair of conductive tuning posts 22 and 24 extend through first substrate 18 electrically connecting the first and second conductive layers 20 an 21. As shown in FIG. 2, the tuning posts 22 an 24 are aligned diametrically opposed to one another on opposite sides of the center of the substrate major surface 23. The precise locations of the two tuning posts 22 and 24 are a function of the radio frequencies to be received and/or transmitted by the antenna. For the exemplary antenna intended for use at cellular telephone frequencies, each tuning post 22 and 24 is spaced 0.25 inches from the center of the circular major surface 23. Each tuning post 22 and 24 can be a solid rivet, which extends through the substrate and the first and second conductive layers 20 and 21, with a head at both ends soldered to the respective conductive layer. Alternatively, the tuning post may be inserted through the substrate 18 and then the first and second conductive layers are deposited on the major surfaces of the substrate in electrical contact with the tuning posts.

The second conductive layer 21 abuts the exterior surface of the glass 12, as shown in FIG. 1. A decorative plastic cover 26 extends over the substrate 18 and may be colored to match or complement the color of the body of the motor vehicle. The sides of the cover 26 are angled for aerodynamic and aesthetic purposes.

Referring to FIGS. 1 and 3, the interior element 16 is formed with a second substrate 30 of a dielectric material, such as PMI foam. The second substrate 30 has a shape and size that match the shape and size of the first substrate 18, which in the embodiment illustrated in the drawings is disk-shaped. The first major surface 31 of the second substrate 30 which is adjacent to the glass 12 has first and second flat copper electrodes 32 and 34 deposited thereon. The first electrode 32 has a circular shape and is centrally located on the first major surface of the second substrate 30. The second electrode 34 has an annular shape extending around the first electrode 32 with a small gap therebetween and continues to the edge of the second substrate 30. With a second substrate 30 having a diameter of three inches, the first electrode 32 has a diameter of 0.9 inches, while the annular second electrode 34 has an inner diameter of one inch and extends to the curved edge of the second substrate 30. As shown in FIG. 1, the opposite major surface of the second substrate 30 is entirely covered by a third copper electrode 36.

A conventional coaxial cable connector 38 is attached to the curved edge of the second substrate 30. A central terminal of connector 38 is attached to one lead 40 of a capacitor 42 which has another lead connected to the center of the first electrode 32. The outer terminal of connector 38 is connected by a conductor 44 to a point along capacitor lead 40. The conductor 44 acts as an inductive element and for cellular telephone frequency operation, may be a one inch long wire that is 0.02 inches in diameter. A slot is cut in the second substrate 30 to accomodate the capacitor 42 and the conductor 44. The outer terminal of connector 38 also is connected by a copper pad 46 to the third electrode 36 on second substrate 30. The connector 38, capacitor 42 and conductor 44 serve as a coupler for attaching a coaxial cable from a transceiver to the antenna 10. Alternatively, the coaxial connector 38 may be eliminated and the cable attached directly to the other coupler elements.

A shunt 48 extends between the second and third electrodes 34 and 36 around the edge of the second substrate 30 at a location which is diametrically opposed to the position of the coaxial connector 38. For example, the shunt 48 may be a thin, 0.25 inch wide conductive strap soldered to the second and third electrodes 34 and 36.

The interior element 16 has an outer plastic case 50 extending around the three sides which are exposed when the element is mounted on the glass 12.

The locations of the two tuning posts 22 and 24 have been specified for an antenna that is to resonate in the frequency band for cellular telephone communication (i.e. 825–890 MHz). The number and location of the tuning posts as well as the reactance values of capacitor 42, conductor 44 and shunt 48 may be varied to adjust the impedance of the antenna for use at other frequencies. For a specific antenna design, the number and location of the tuning posts and reactance values of components 42, 44, and 48 are varied until the antenna impedance or the standing wave ratio (VSWR) measured at the connector 38 has a value matched to the requirements for the coaxial cable. The antenna impedance at a given frequency also is a function of the dielectric constant and thickness of substrates 18 and 30.

When the antenna 10 is mounted on the glass 12, the interior element 16 is positioned so that the coaxial connector 38 is appropriately oriented for attachment of the coaxial cable from the transceiver. As noted previously, a conventional adhesive is employed to attach the interior element 16 to the glass 12. Once the interior element 16 has been properly positioned, the exterior element 14 is attached by adhesive to the outer surface of glass 12, centered over the interior element.

During operation of the antenna 10, signals from the transmitter of the cellular telephone are sent through a coaxial cable to the connector 38 and excite the interior element 16. The signals are coupled through the glass 12 between the interior element 16 to the exterior element 14 from which the signals radiate through the air. Similarly, incoming cellular telephone radio frequency signals are received by the exterior element 14 and are coupled through the glass 12 to the interior element 16 from which the signals are sent through the coaxial cable to a receiver section.

I claim:

1. An antenna for mounting on a piece of glass, said antenna comprising:

a first element for attaching to one side of the piece of glass and including a first substrate of a dielectric material having two major surfaces, a first conductive layer on one major surface of said first substrate, a second conductive layer on another major surface of said first substrate, and a plurality of tuning posts extending through said first substrate with each tuning post electrically connected to said first and second conductive layers; and a second element for attaching to another side of the piece of glass and opposite to said first element, said second element including a second substrate of a dielectric material having two major surfaces with an edge surface therebetween which edge surface defines a perimeter of the second substrate, a first electrode centrally located on one major surface of said second substrate, a second electrode having an annular shape and located on the one major surface of said second substrate extending around said first electrode, a third electrode on another major surface of said second substrate, a shunt connected between the second and third electrodes, and a coupling to apply an excitation signal between said first electrode and said third electrode.

2. The antenna as recited in claim 1 wherein said plurality of tuning posts comprise first and second conductive elements located on a line passing through a center of the one major surface of said first element and located on opposite sides of the center.

3. The antenna as recited in claim 1 wherein said shunt comprises electrically conductive material extending across the edge surface of the second substrate and between said second and third electrodes.

4. The antenna as recited in claim 1 wherein said second substrate is disk-shaped and wherein said shunt extends between the second and third electrodes across the edge surface at a point that is diametrically opposed to another point at which said coupling is connected to said third electrode.

5. The antenna as recited in claim 1 wherein said coupling comprises a connector with a first terminal connected to said third electrode and with a second terminal; a capacitor connecting the second terminal to the first electrode; and an inductive element coupled between the first and second terminals.

6. The antenna as recited in claim 5 wherein said connector is located on the edge surface of said second substrate; and wherein said shunt comprises a conductor extending between the second and third electrodes across the edge surface at a side of said second substrate opposite said connector.

7. An antenna for mounting on a glass window, said antenna comprising:

a first element for attaching to one side of the glass window and including a first substrate of a dielectric material having circular first and second major surfaces wherein the first major surface for facing toward the glass window, a first electrically conductive layer on the first major surface, a second electrically conductive layer on the second major surface, and a plurality of tuning posts extending through said first substrate with each tuning post electrically connected to said first and second electrically conductive layers; and a second element for attaching to another side of the glass window, said second element comprising a second substrate of a dielectric material having circular third and fourth major surfaces with an edge surface therebetween which edge surface defines a perimeter of the second substrate, wherein said third major surface for facing toward the glass window, a circular first electrode centrally located on the third major surface, a second electrode having an annular shape and located on the third major surface around said first electrode, a third electrode on the fourth major surface, a connector located at a first point on the edge surface of said second substrate and having first and second terminals wherein the first terminal is connected to said third electrode, a capacitor connected between the second terminal and the first electrode, an inductive element coupled between the first and second terminals, and a shunt electrically connecting the second and third electrodes at a second point on the edge surface of said second substrate which is diametrically opposed to the first point.

8. The antenna as recited in claim 7 further comprising a cover of electrically insulating material extending over said first element.

9. The antenna as recited in claim 7 further comprising a cover of electrically insulating material extending over said second element.

10. The antenna as recited in claim 7 wherein said plurality of tuning posts comprise first and second conductive elements diametrically opposed to one another on opposite sides of a center of said first substrate.

* * * * *